US006763827B2

(12) United States Patent
Reed, III

(10) Patent No.: US 6,763,827 B2
(45) Date of Patent: Jul. 20, 2004

(54) EMERGENCY AIR SYSTEM FOR KAYAKS

(76) Inventor: John A. Reed, III, 36 Scenic Rd., Fairfax, CA (US) 94930

( * ) Notice: Subject to any disclaimer, the term of this patent is extended or adjusted under 35 U.S.C. 154(b) by 286 days.

(21) Appl. No.: 09/769,108

(22) Filed: Jan. 24, 2001

(65) Prior Publication Data

US 2001/0027787 A1 Oct. 11, 2001

Related U.S. Application Data

(63) Continuation-in-part of application No. 09/153,824, filed on Sep. 15, 1998, now abandoned.

(51) Int. Cl.[7] ..... A62B 9/00

(52) U.S. Cl. ..... 128/200.24; 114/334; 114/347

(58) Field of Search ..... 128/200.24, 201.11, 128/201.26, 201.27, 201.28, 202.14, 204.18, 207.14; 114/256, 257, 312, 315, 327, 334, 39.21, 39.23, 55.5, 343, 347; D12/302

(56) References Cited

U.S. PATENT DOCUMENTS 5,265,591 A * 11/1993 Ferguson ..... 128/201.11
5,671,694 A 9/1997 Schoettle
5,845,635 A 12/1998 Hermansen et al.
5,868,130 A * 2/1999 Stier ..... 128/201.28
5,947,116 A 9/1999 Gamow et al.
6,581,591 B1 * 6/2003 Green et al. ..... 128/202.13
2002/0112721 A1 * 8/2002 Beier ..... 128/200.24

FOREIGN PATENT DOCUMENTS

DE 3931968 A1 4/1991
WO 00/27695 * 5/2000 ..... 128/200.24

OTHER PUBLICATIONS

Stephen Dutton, "Snorkel Breathing," Sea Kayaker Magazine, Apr. 1996 (pp. 46–47).

Radical Gear, "Breathing Tube," description sheet (1 page).

* cited by examiner

*Primary Examiner*—Glenn K. Dawson
(74) *Attorney, Agent, or Firm*—Coudert Brothers LLP

(57) ABSTRACT

An emergency air system for kayaks is disclosed. The emergency air system can be coupled to a kayak skirt or may be coupled to the body of the kayak. The air system includes a breathing tube which includes a mouthpiece. Preferably, the breathing tube is secured to the kayak skirt or the kayak body with a pair of opposing, flat washers.

21 Claims, 11 Drawing Sheets

EMERGENCY AIR SYSTEM FOR KAYAKS

This is a continuation-in-part patent application of patent application Ser. No. 09/153,824, filed Sep. 15, 1998, now abandoned.

BACKGROUND OF THE INVENTION

1. Field of the Invention

This invention relates generally to the field of emergency breathing devices, and more particularly to an emergency air breathing system for kayaks.

2. Description of the Prior Art

People have been using kayaks as a means of water transportation for hundreds of years. Kayaks have a relatively flat bottom and are prone to tipping over. The tipping phenomenon is so common that most kayaks have a flexible skirt that creates a relatively water tight seal around the kayakers waist and around the top opening of the rigid body of the kayak. With this seal, a kayaker can flip upside down and then do a special rolling maneuver to right him or herself while the internal portion of the kayak remains relatively dry.

During this rolling maneuver there is obviously a period of time where the kayakers head is underwater. This is usually a short time period and many kayakers practice this rolling maneuver so that in a real life situation they can flip from the upside down position to the right side up position while holding their breath. New kayakers and even veterans sometimes have a hard time completing the roll over within one breath holding period. Therefore, it is a good idea to provide an emergency breathing tube or some other breathing device so that when the kayakers head is underwater he or she can take several breaths if necessary before successfully completing the rolling maneuver.

One such device has been introduced by the Radical Gear Company of Philadelphia, Pa. In its product the lower end of a breathing tube is supported by means of a foam tube holder on the lap of the kayaker. The breathing tube then extends up the skirt of the kayak and proceeds under the life jacket of the kayaker, terminating in a mouthpiece which is meant to be positioned to one side of the kayakers face. A second such device is described in German Patent DE 3931961 A1 to Schultz, where a tube extends up the skirt of the kayak, proceeds under the life jacket of the kayaker, and terminates in a mouthpiece in front of the kayaker's face. While these configurations do give a degree of emergency breathing when the kayaker is submerged, there are some serious disadvantages to the designs.

One disadvantage is that because a kayaker is constantly moving and twisting, there is a tendency for the mouthpiece portion to migrate to an inappropriate position, such as under the life vest rather than above it. In this case the kayaker would have to take valuable time to reorient the mouthpiece to the proper position and, more importantly, the kayaker has to take at least one hand off the paddle thereby increasing the chance of losing the paddle.

A further disadvantage of the breathing devices by Radical Gear Co. and Schultz is that neither the mouthpiece portion of the breathing tube nor the opposite end of the breathing tube is sealed. Therefore, the kayaker can receive incoming water which can potentially be breathed in by the kayaker. The tube must be purged of water before breathing. This action is difficult because of the length of the tube and the tendency of water to collect on the inside walls of the tube which can run back into the mouth of the kayaker.

In both the device by Radical Gear Co. and the German Patent (Schultz, DE 3931961 A1), a further disadvantage is that, by not being permanently attached to the kayak or the skirt, they are both prone to being left behind on shore. Weather and water conditions often deteriorate unexpectedly, resulting in an unanticipated need for an emergency breathing device.

An additional disadvantage of both the Radical Gear Co.'s device and the Schultz device is that both allow the kayaker to adopt a vulnerable position, where the head is lower in the water, and prone to impact with obstruction. The preferred position upon capsize is a tucked position where the face is as close to the kayak's deck as possible.

Finally, there is a disadvantage in the prior art in that during the rolling maneuver, the torso and head of the kayaker must be free to bend to a series of extreme positions, first, to bend forward and to one side (the "set-up" position), then outstretched to this side, then sweeping to a position outstretched on the opposite side, and finally stretched backward so that when the roll is completed, the kayaker is lying, head back, on the aft deck. It is apparent that during this process, a tube of fixed length running from the mouth down the chest would limit the necessary upper body movements considerably.

An attempt to solve the emergency breathing problem for kayakers was proposed by Fred Schoettle in his U.S. Pat. No. 5,671,694 issued Sep. 30, 1997. This patent describes an emergency breathing device for kayakers in which a pair of air bladders are installed inside the body of the kayak. A thin flexible hose is attached to the bladders which terminates at its opposite end by a mouthpiece which has a hand operated on-off valve. A hook mounted to the side wall of the kayak secures the mouthpiece when not in use. The main problem with this design is that to use this system, the seal between the skirt and the deck must be violated. This would result in a significant amount of water flooding into the boat. Another problem is that the kayaker has to use two hands to remove the mouthpiece for use and to turn the valve to the flow position. This means that the kayaker has to let go of his or her kayak paddle to use the device. Losing ones paddle puts the kayaker in danger because he or she has to struggle to retrieve the paddle. In many cases, retrieving the paddle may quickly become impossible. Additionally, because of the length of the flexible tube, the kayaker may unintentionally get tangled in the tube as well has have difficulty in breathing due to the nature of the long thin tube. Finally, the proposed air bladders take up valuable space in the interior of the kayak and add complexity and cost to the emergency apparatus described.

Therefore, what is needed and what has been invented is a kayak having an emergency breathing device which overcomes the disadvantages of the prior art. What is further needed and what has been invented is a method for retrofitting existing kayaks to produce kayaks not possessing the disadvantages associated with the prior art.

SUMMARY OF THE INVENTION

One object of the invention is to provide a better emergency breathing system that allows a kayaker to breathe while underwater.

Another object of the invention is to provide an emergency breathing system that does not collect water while in the standby mode.

Another object of the invention is to provide an emergency breathing system that is easy for the kayaker to reach while under water.

Another object of the invention is to provide an emergency breathing system where the kayaker can not become dangerously entangled by the breathing tube while in the submerged position.

Another object of the invention is to provide an emergency breathing system which is normally available as needed.

Another object of the invention is to provide an emergency breathing system which is simple in construction and easy to manufacture.

Other objects and advantages of the present invention will become apparent from the following descriptions, taken in connection with the accompanying drawings, wherein, by way of illustration and example, preferred embodiments of the present invention are disclosed.

One embodiment of the invention is directed to an emergency air system for kayakers comprising a mouthpiece connected to a breathing tube which pierces the top surface of the kayak and is held in place perpendicularly to the top surface of the kayak, such as by a pair of opposed flat washers. The washers, or the like, are capable of being forced together by an internally threaded nut, or other standard securing means, that is capable of securing the breathing tube to a kayak skirt or to the upper deck of the kayak. The mouthpiece of the breathing tube contains a mouth-operated valve which is capable of opening the air passage of the breathing tube when needed, but preventing water from entering the tube when not needed. A hollow chamber is located below the mouthpiece which acts to catch and remove any purged water so that the water does not flow back into the kayaker's mouth. The length of the breathing tube above the top surface of the kayak may be adjusted by loosening the threaded nut, adjusting the length and then tightening again. In this way a kayaker may have access to emergency air coming from inside the kayak when in the submerged position and yet, when not in use, the breathing tube remains free of water. The breathing air coming from inside the kayak may come from the void space existing underneath the top deck, the skirt, and between the inside hull of the kayak, or from an air-supply tank, or carbon dioxide removing filter, disposed inside the kayak. The breathing tube is accessed by the kayaker bending his or her head and torso forward, putting his or her mouth over the mouthpiece and forcing the mouthpiece to the open position by applying downward pressure with his or her teeth. In this way a kayaker may open the valve in the mouthpiece without taking a hand or hands away from holding the kayak paddle. Additionally, there is no danger of the kayaker becoming dangerously entangled in or connected by the breathing tube to the kayak when the kayaker wishes to become free of the kayak.

The present invention provides a kayak comprising a kayak body having a top deck with a deck opening. The kayak includes a kayak skirt disposed on the kayak body and around the kayak opening. The kayak skirt includes a structure defining a skirt opening and a skirt aperture. An emergency air system at least partly is supported by the kayak skirt and includes a structural portion passing through the skirt aperture.

The present invention also provides a kayak comprising a kayak body having a kayak deck defining a deck opening and a deck aperture; and an emergency air system at least partly supported by the kayak deck and including a structural portion passing through the deck aperture.

The present invention further also provides a method for a kayaker sitting in a kayak to receive a supply of air under water after the kayak has overturned. The method comprises providing a kayak having a kayaker with an upper torso extending through a deck opening of a top deck and having an emergency air system disposed within a deck aperture of the top deck or within a skirt aperture of the kayak; capsizing the kayak to cause the upper torso of the kayaker to be submerged in water; bending the upper torso forward until the mouth of the kayaker is in close proximity of a mouthpiece of the emergency air system; disposing the mouthpiece in the mouth of the kayaker such that the kayaker is able to receive a supply of air. The disposing comprises biting of the mouthpiece by the kayaker, or pulling the mouthpiece towards the kayaker's mouth by a strap or other handle, and then biting the mouthpiece. The bending of the upper torso continues until the upper torso is generally parallel to the top deck.

Another feature of the present invention is a method for retrofitting a kayak with an emergency air system comprising:

providing a kayak having a top deck including a deck opening and having a kayak skirt with a skirt opening;

placing an aperture in either the top deck or the kayak skirt; and disposing an emergency air system in the aperture.

Further advantages of the present invention are that it is relatively permanent, being secured through an aperture in the skirt or deck. This means that it is not prone to being forgotten at the outset of the voyage. Often, the need for rolling or an emergency breathing device are not apparent at that time. The position taken by the kayaker in order to engage the device is the preferred, defensive tucked position. As the device is secured in an aperture in front of the kayaker, and not on his or her body, the head and torso are given much more flexibility. Extreme flexibility is needed to perform a rolling maneuver, side to side and fore and aft, which the present invention does not restrict. Should a roll fail, the kayaker need only return to the tucked position and re-engage the mouthpiece.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
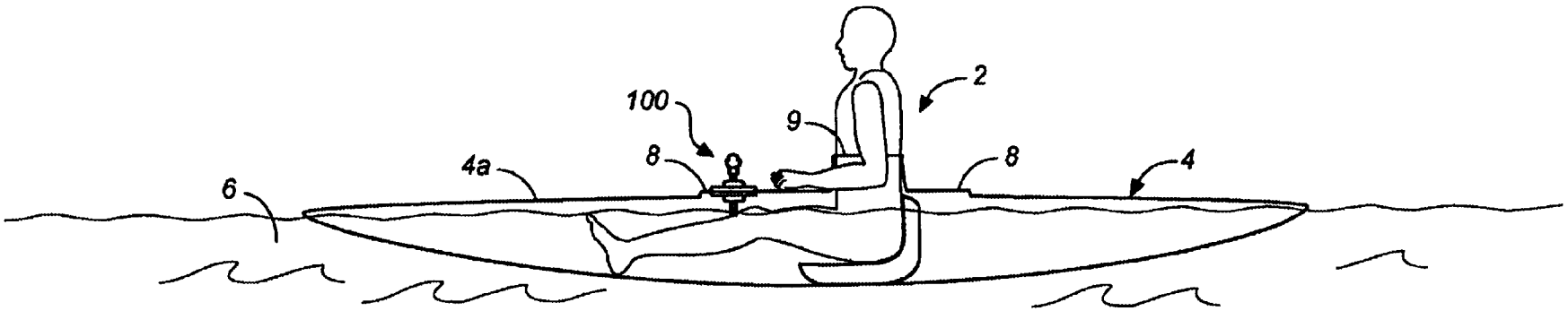
FIG. 1 is a side section view of a kayaker in an upright position in a kayak with the breathing tube of the present invention in place.

FIG. 1 shows a kayaker 2 sitting in a kayak 4 while paddling in the water 6. Referring to FIGS. 1, 3, 4, 7, and 10, kayak 4 has a top deck 4*a* which may include a deck aperture 4*d*. The emergency breathing system of the present invention, generally illustrated as 100, is shown in FIG. 1, mounted in the kayak skirt 8 having a skirt opening 8*a*, where through kayaker 2 passes. The emergency breathing system 100 in FIG. 1 is more specifically mounted in a skirt aperture 8*b*. The skirt 8 is attached around and/or along the perimeter 4*c* of opening 4*b* in the top deck 4*a* of the kayak 4 and at the inner perimeter 9*a* to the torso of the kayaker 2. FIG. 1 shows the normal position for the kayaker 2. Note that the emergency breathing system 100 is safely out of the way at this time. In FIGS. 3 and 7–9 the emergency breathing system 100 passes through skirt aperture 8*b*. In FIGS. 4 and 10–11 the emergency breathing system 100 passes through deck aperture 4*d*. The air supply for the breathing system 100 comes from within the kayak 4, such as from the void space existing underneath the top deck 4*a*, the skirt 8, and between the inside hull of the kayak, or from an air-supply tank or carbon dioxide absorbing filter (not shown) disposed inside the kayak 4.

Figure 2:
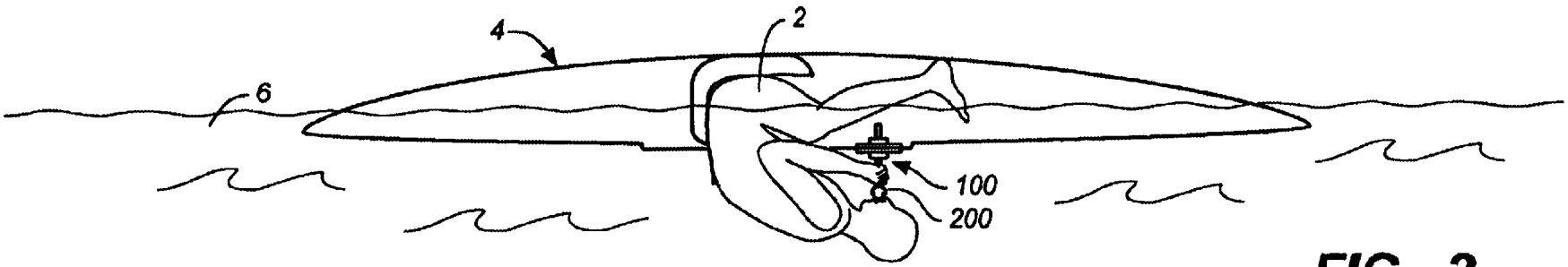
FIG. 2 is a side section view of a kayaker in the upside down position showing the kayaker using the breathing tube of the present invention.

FIG. 2 shows the kayaker 2 in an upside down or submerged position where his or her head is under water 6. In this position the kayaker 2 can lean forward so that his or her mouth is within reach of the mouthpiece assembly 200 of the breathing system 100 of the present invention. It is to be noted that this tucked position as illustrated is the preferred starting position when trying to roll back to the upright position because it is the best defense against being struck by underwater obstructions. Note also that the kayaker 2 does not need to let go of the paddle to execute the emergency breathing procedure.

Figure 3:
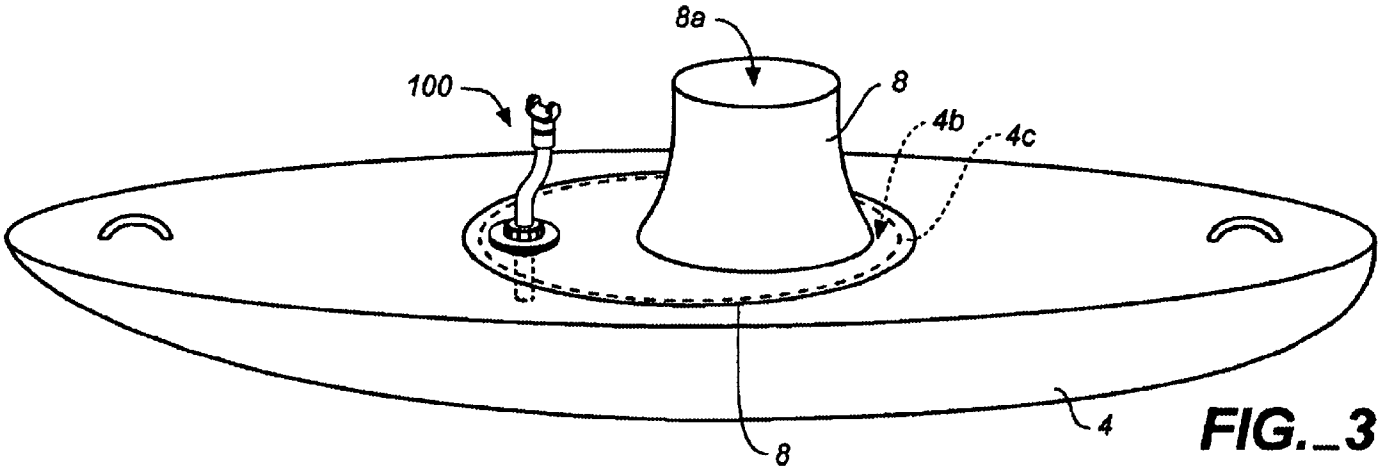
FIG. 3 is a perspective view of a kayak with the breathing tube of the present invention mounted to the skirt of the kayak.
Figure 4:
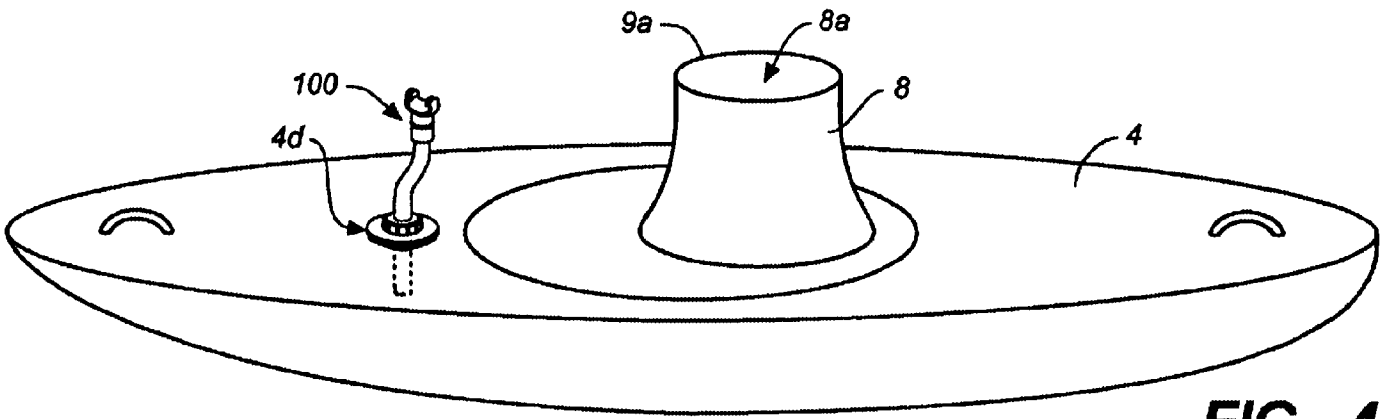
FIG. 4 is a perspective view of a kayak with the breathing tube of the present invention mounted to the top deck of the kayak.
Figure 5:
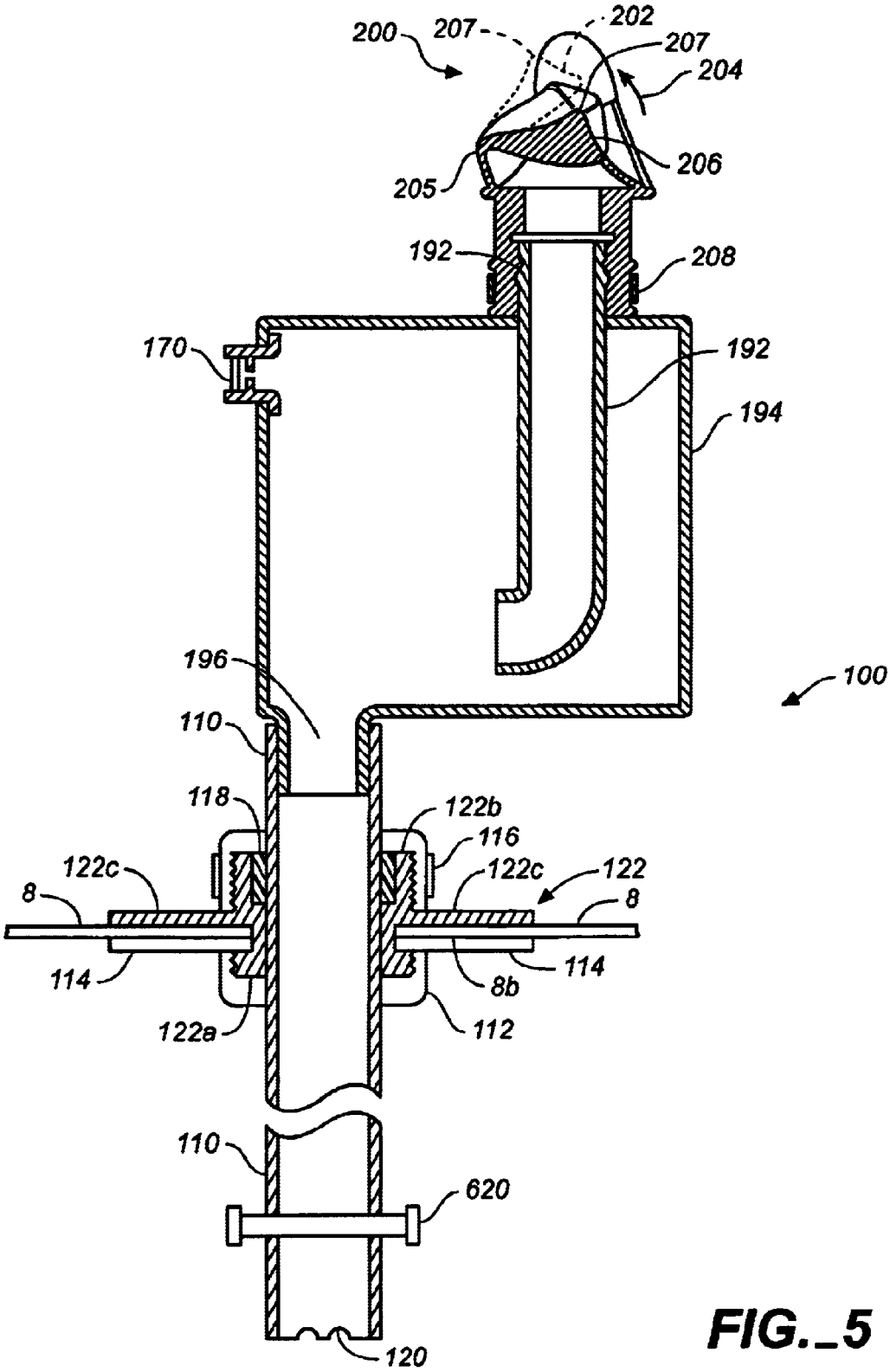
FIG. 5 is a side section view of the emergency breathing tube of the present invention.

FIG. 3 shows a perspective view of a kayak 4 with the system 100 of the present invention mounted in the skirt 8 of the kayak. To mount the breathing system 100 a kayak owner would simply cut a hole (i.e., skirt aperture 8*b*) of proper diameter into the skirt 8 and mount the system 100 as shown in FIG. 5. For taller people or for kayaks 4 that have smaller cockpit openings (i.e., opening 4*b*) it may be advantageous to mount the breathing system 100 into the top deck 4*a* of the kayak 4 as shown in FIG. 4. This configuration involves cutting a hole (i.e., deck aperture 4*d* shown best in FIG. 10) in the deck 4*a*, but since most kayak bodies are made of thin, light weight materials, the necessary hole (i.e., deck aperture 4*d*) could be cut with conventional tools such as a hand drill or a small hand saw.

Figure 14:
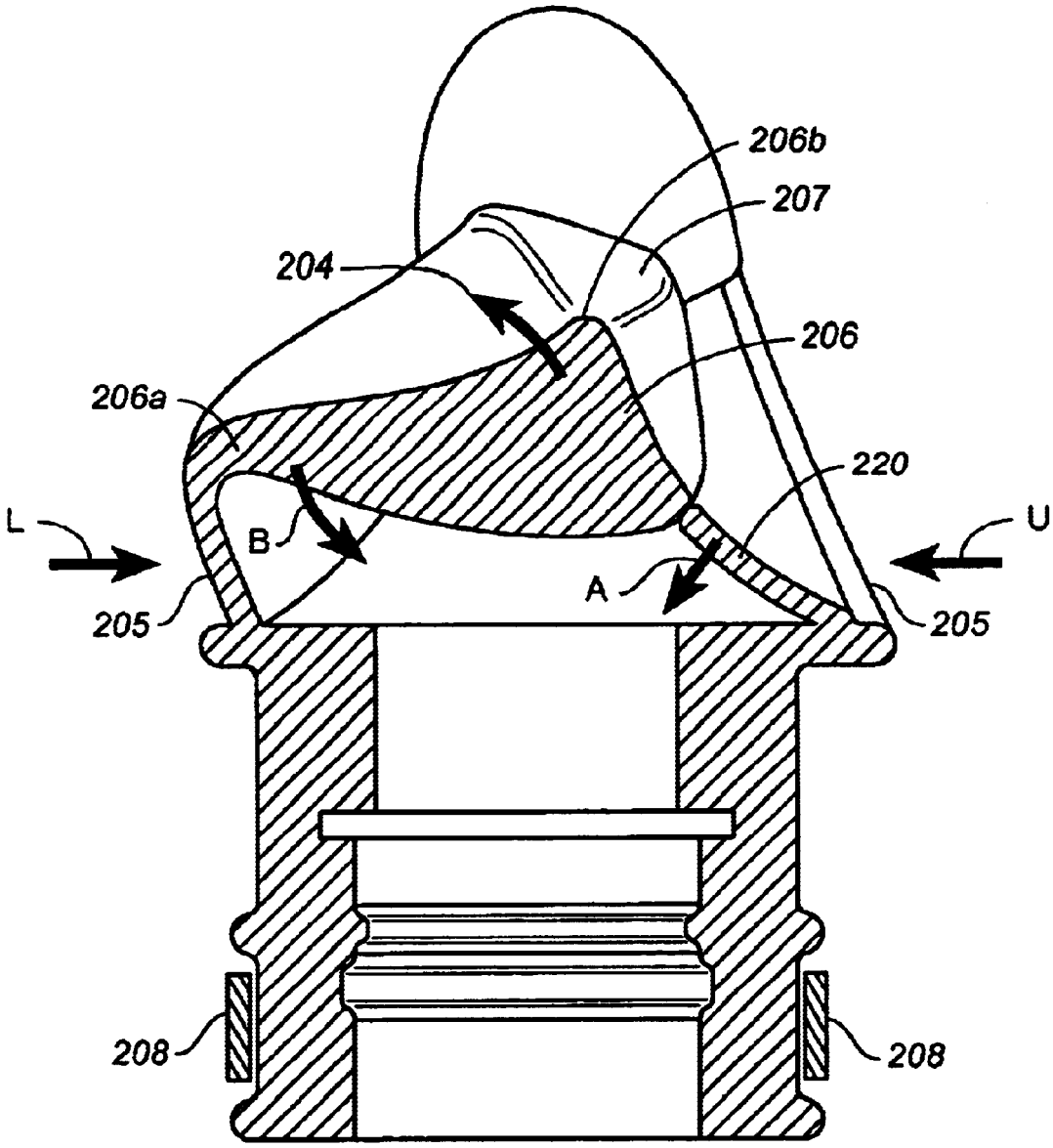
FIG. 14 is a side sectional view of the mouthpiece illustrated in FIG. 12, showing vectors representing the biting contact and direction of biting forces of upper and lower teeth, as well as moving parts of the mouthpiece.
Figure 15:
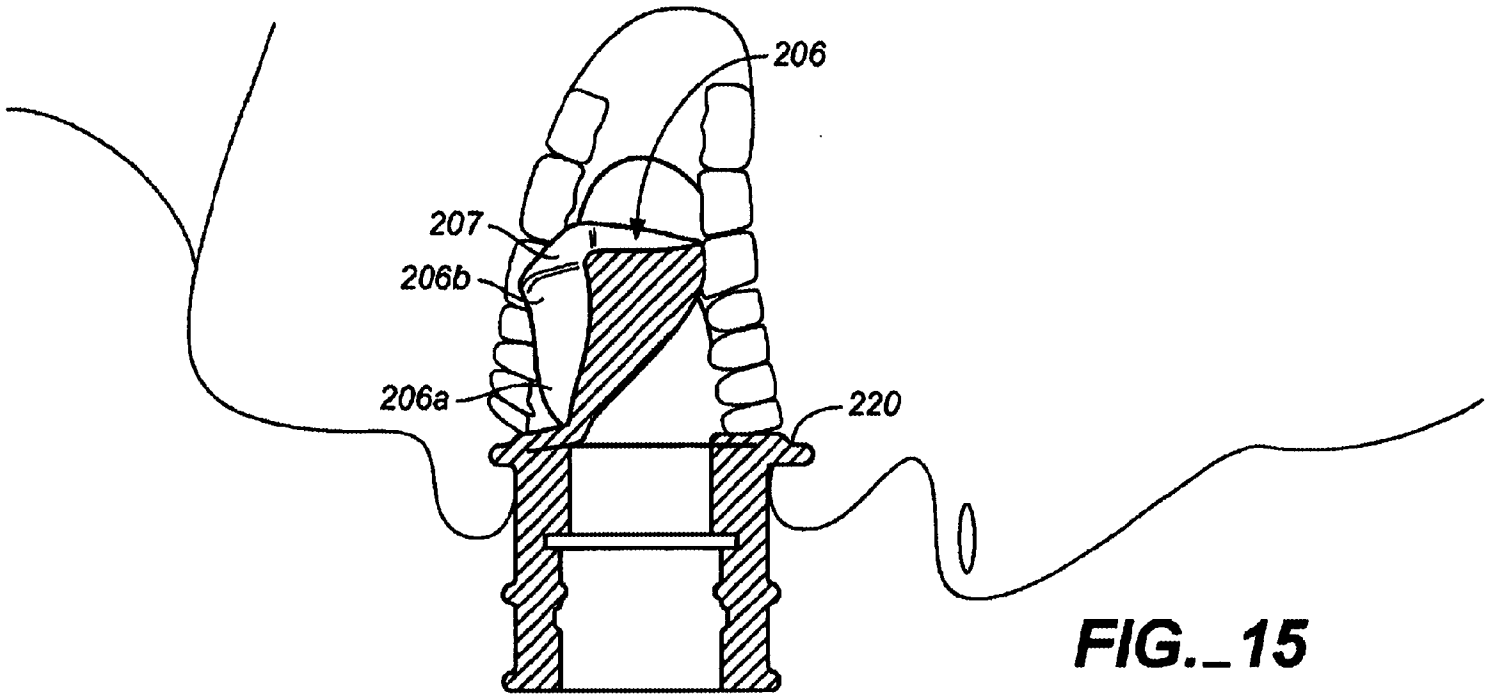
FIG. 15 is a side sectional view of the mouthpiece in the open position being engaged by the kayaker's mouth.

FIG. 5 shows a cross section view of a breathing system 100 embodiment of the present invention. Mouthpiece assembly 200 is made of flexible plastic such as silicone, or elastomeric vinyl. The top flap 206 is normally in the down position as shown in FIG. 5. This position prevents water from accidentally entering the top of the breathing tube 110. Top flap 206 has a raised roof-like portion 207 so that the kayaker 2 takes on a minimum of unwanted water while engaging his or her lips and mouth onto the mouthpiece 200. When the kayaker 2 wants to open the top flap 206 he or she uses his or her teeth to exert downward pressure at points 205—205 thereby causing top flap 206 to pivot upward in the direction of arrow 204 so that it is in the open position shown by dotted line 202 in FIG. 5 and solid lines in FIG. 15. Vectors U and L shown in FIG. 14 represent biting contact points and biting force directions for upper and lower teeth, respectively. Upon biting contact and force, lower flap 220 moves in direction of arrow A into the position in FIG. 15, and structural parts 206*a* and 206*b* of top flap 206 move in direction of arrows B and 204, respectively, and also into the position shown in FIG. 15. Flexible mouthpiece 200 is reinforced by rigid connector tube 192. Tube 192 extends about three inches below mouthpiece 200 and is surrounded by hollow chamber 194.

Chamber 194 acts as a reservoir for purged water so that the water can not flow back into the kayaker's mouth. One way valve 170 allows purged water to exit the chamber 194. Chamber 194 has an exit port 196 to which flexible breathing tube 110 is frictionally attached. Of course the emergency breathing device 100 of the present invention could be designed without the purge reservoir 194, having the breathing tube 110 extend directly from the mouthpiece 200.

Mouthpiece assembly 200 is firmly crimped to connector tube 192 by cinch strap 208. The total length of breathing tube 110 is about fourteen inches but could be somewhat longer or shorter without seriously affecting its use. The breathing tube 110 is held onto the kayak skirt 8 or top deck 4*a* by sandwiching the skirt 8 or top deck 4*a* between two large flat washers 114, 122, which produce a water tight engagement. Washer 122 has an integral flange 122*c* and an integral threaded portion 122*a* extending below the flange 122*c* for threadably engaging internally threaded nut 112. Washer 122 also has an integral threaded portion 122*b* extending above the flange 122*c* for threadably engaging nut 116. Upper tightening nut 116 acts to constrict the inner diameter of internal rubber ferrule 118 when tightened, thereby causing ferrule 118 to impinge on breathing tube 110 thereby holding it at the desired height. The kayaker 2 may adjust the height of breathing tube 110 by loosening nut 116, sliding tube 110 up or down, and then tightening nut 116. Internally threaded nut 112 acts to secure flat washer 114 against a bottom of the skirt 8, or against a bottom of the top deck 4*a*. Scallops 120 at the end of breathing tube 110 prevent air restriction if the bottom of tube 110 should be pressed against a flat surface. Holes adjacent to end of tube 110 could also be used to prevent air restriction. A keeper pin 620 ensures breathing tube 110 is not inadvertently removed, and is positioned so as to avoid introducing any bilge water.

Figure 6:
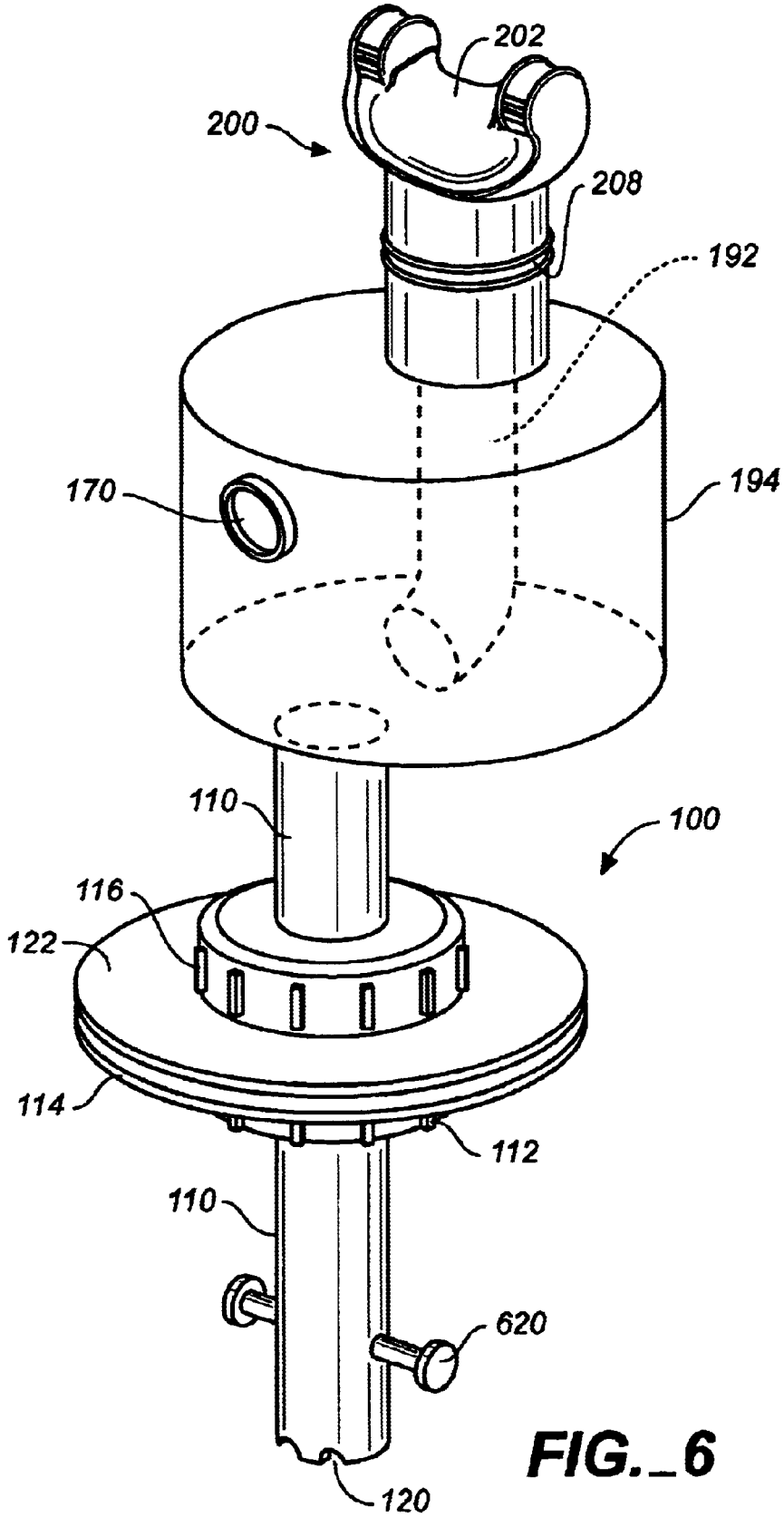
FIG. 6 is a perspective view of the breathing tube device of the present invention.
Figure 7:
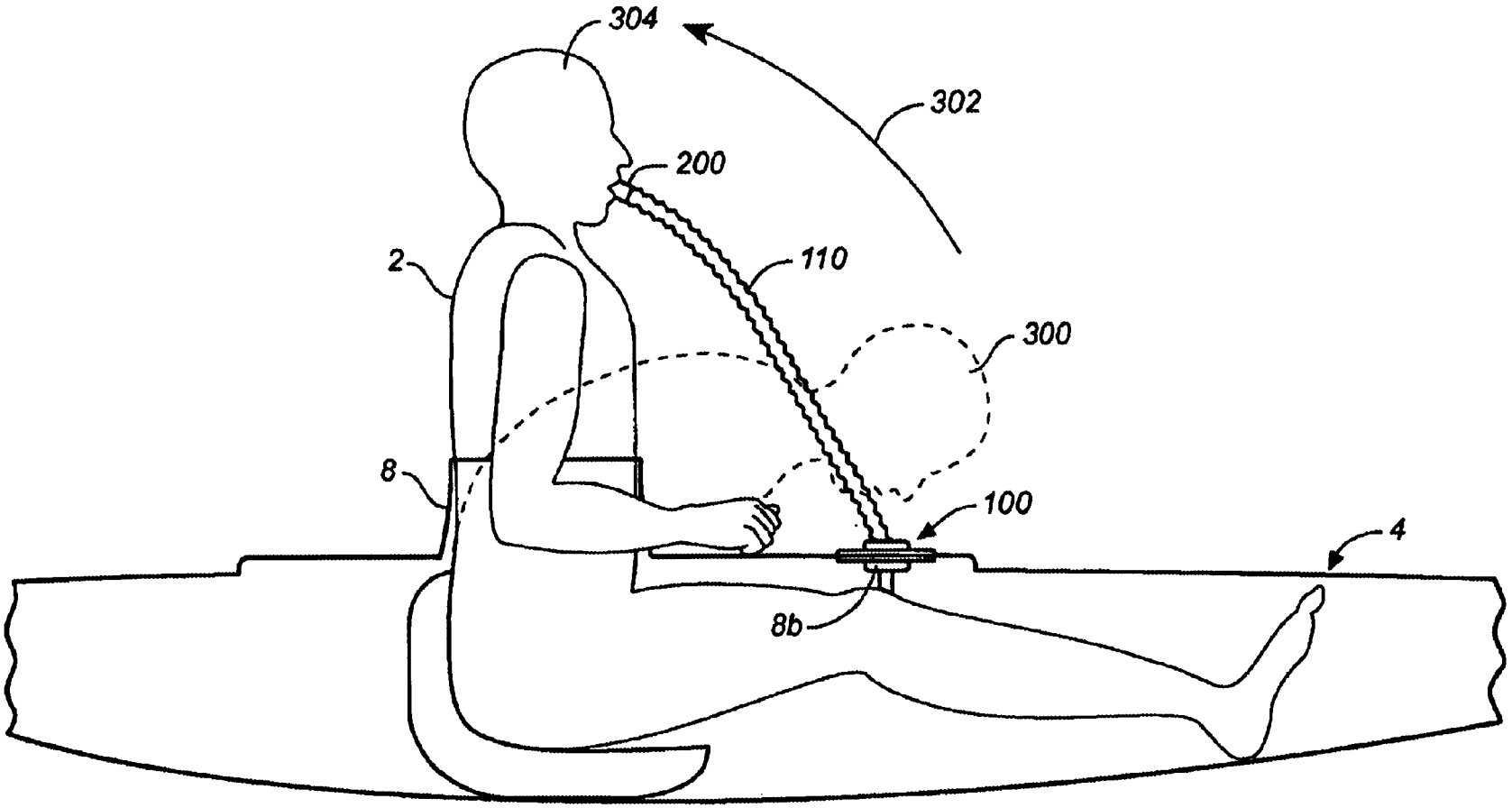
FIG. 7 is a side view of a kayaker using an alternate embodiment of the present invention.

FIG. 6 shows a perspective view of the emergency breathing system 100 of the present invention for greater clarification. FIG. 7 shows an alternate embodiment where the breathing tube 110 is expandable and collapsible in an accordion fashion. In this embodiment the kayaker 2 bends at the torso to position his or her head at 300 (see FIG. 7) on the mouthpiece 200. The kayaker 2 then lifts in direction of arrow 302 with his or her head to the upright position 304. This configuration allows the kayaker 2 to straighten up after fastening his or her mouth on the mouthpiece 200 thereby allowing the kayaker 2 to more easily complete the rolling maneuver to the upright position without removing the mouthpiece 200 from the mouth of the kayaker 2. This same embodiment of the invention may be employed when the emergency breathing system 100 passes through the deck aperture 4*d* instead of the skirt aperture 8*b* shown in FIG. 7.

By using the emergency breathing system 100 of the present invention a kayaker 2 can be in an inverted position and have easy access to an emergency air supply. The breathing system 100 is protected from unwanted water by a mouth operated valve at the top and a purge reservoir at the bottom. The kayaker 2 is not restrictively attached to the kayak 4 by the emergency breathing system 100 so if the kayaker 2 needs to become free of the kayak 4 he or she is unencumbered. The kayaker 2 does not need to use his or her hands to operate the breathing system 100 of the present invention so he or she does not have to let go of the kayak paddle.

Figure 8:
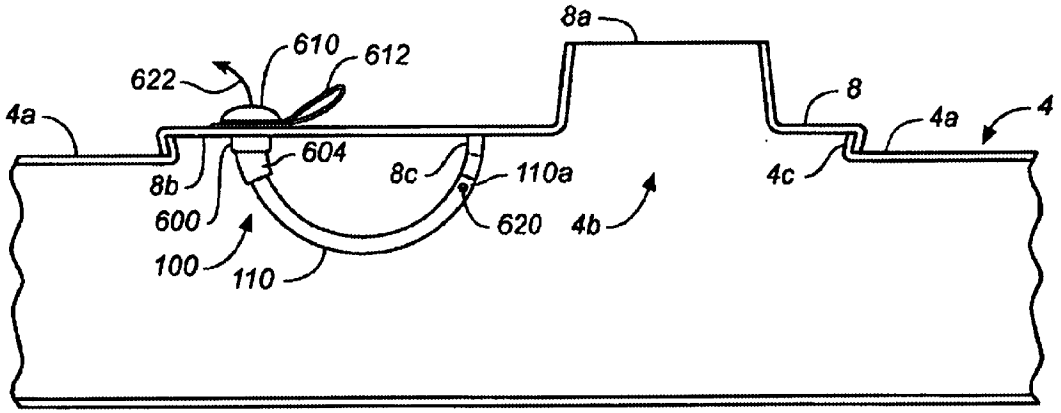
FIG. 8 is a side elevational view of another embodiment of the present invention.
Figure 9:
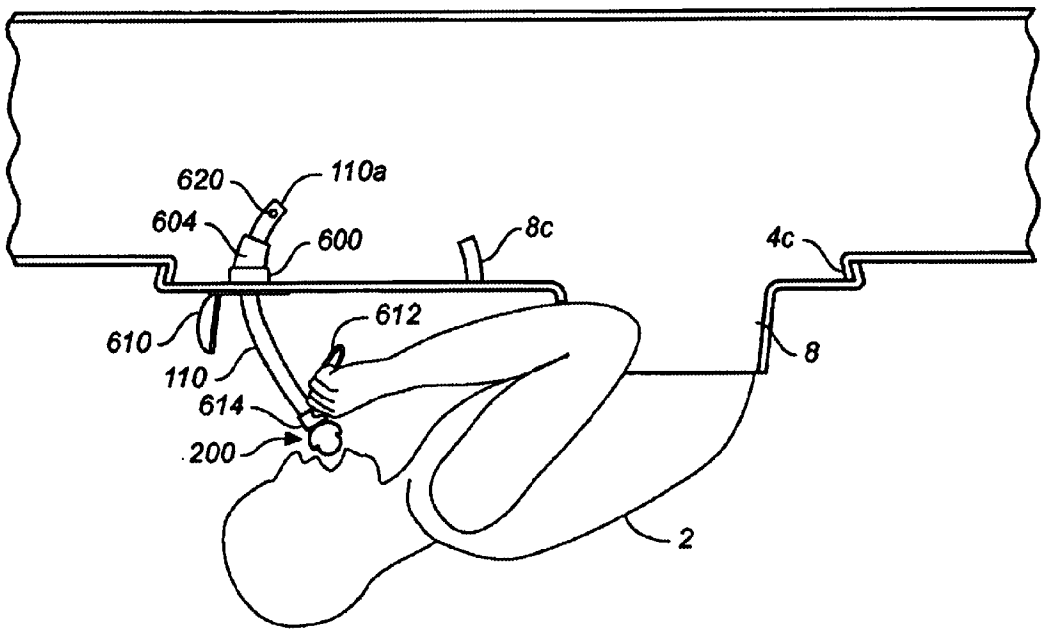
FIG. 9 is a side elevational view of a kayaker using the embodiment of the invention illustrated in FIG. 8.
Figure 10:
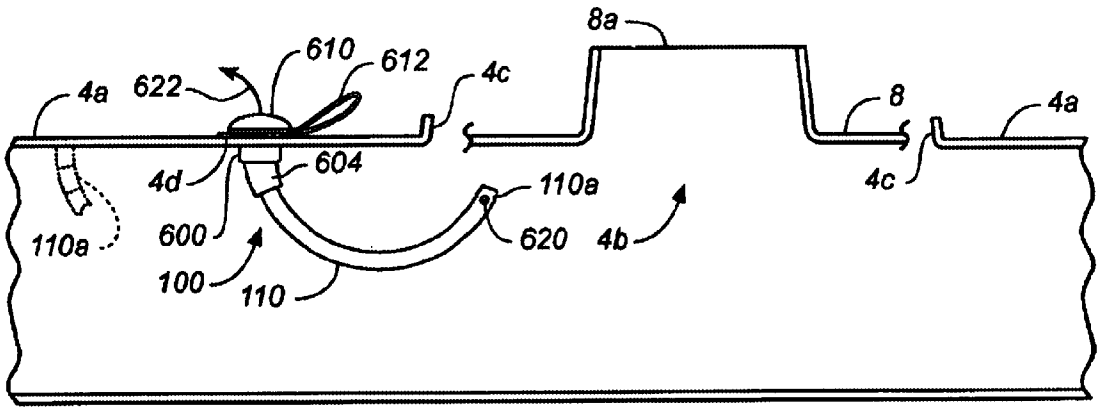
FIG. 10 is a side elevational view of yet another embodiment of the present invention.
Figure 11:
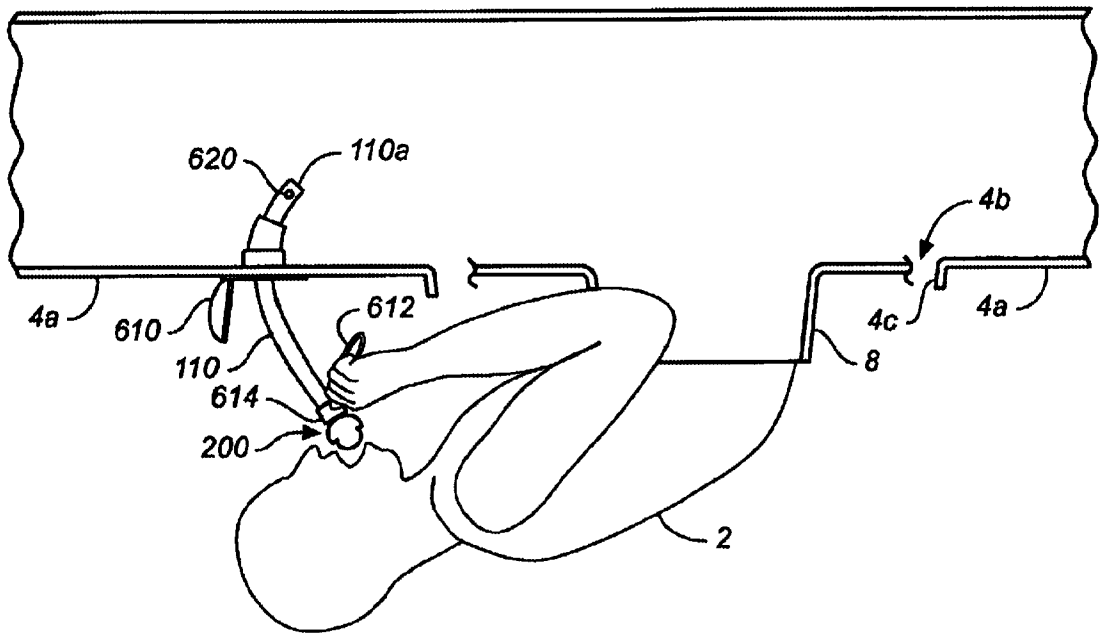
FIG. 11 is a side elevational view of a kayaker using the embodiment of the invention illustrated in FIG. 10.
Figure 12:
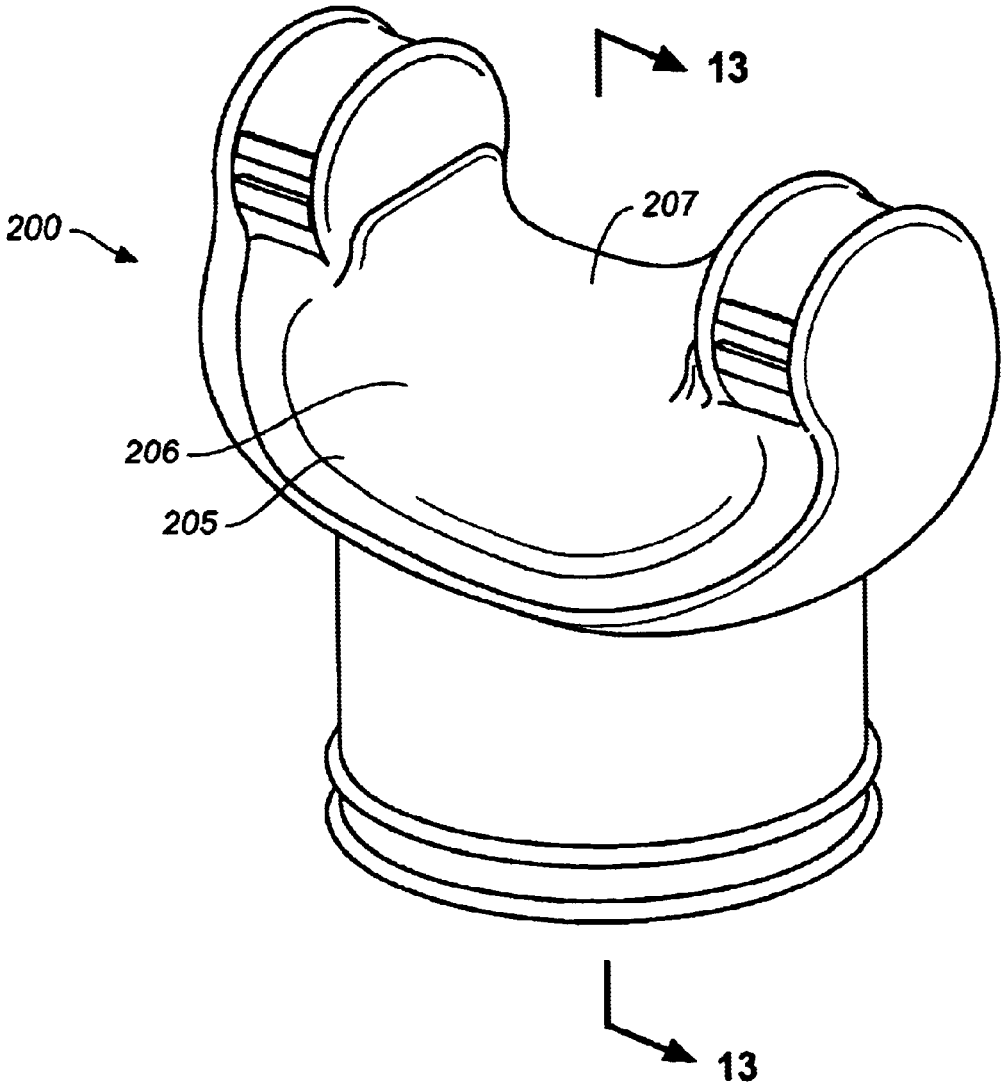
FIG. 12 is a perspective view of the mouthpiece of the present invention.
Figure 13:
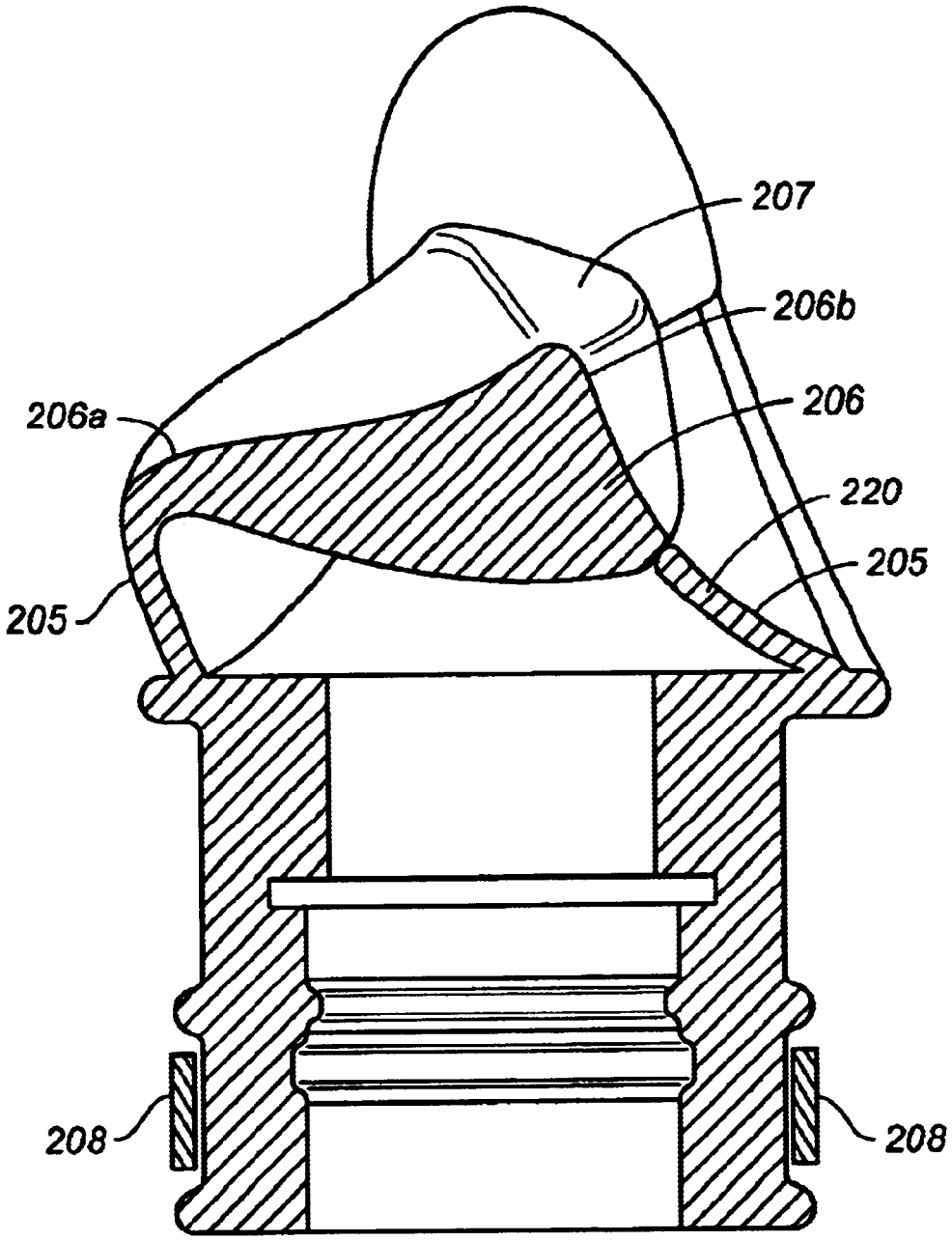
FIG. 13 is a vertical sectional of the mouthpiece taken in direction of the arrows and along the plane of line 13—13 in FIG. 12.

Referring now to FIGS. 8–11 there is seen another embodiment of the present invention. In FIG. 8 the emergency breathing system 100 passes through skirt aperture 8*b* and including a depending collar 600 water-tightly fitted in skirt aperture 8*b*. A cap 610 pivotally attaches to collar 600. A strap 612 is bound to a collar or an eyelet 614 which conveniently engages breathing tube 110 circumferentially. Eyelet 614 typically seats in collar 600. Integrally formed with collar 600 is a lower collar 604 where through breathing tube 110 slidably passes. Breathing tube 110 has a tube end 110*a* which is normally removably stored in a cylindrical skirt pocket 8*c* (see FIG. 8). When the kayak 4 is upside down, as shown in FIG. 9, the kayaker 2 may simply grasp strap 614 and pull downwardly, causing cap 610 to pivot in direction of arrow 622 (see FIG. 8) and unseating eyelet 614 from collar 600 and allowing the tube end 110*a* to unseat from skirt pocket 8*c* and breathing tube 110 to slidably pass through collars 604 and 600 such that the kayaker 2 may readily engage the mouthpiece 200 (see FIG. 9). A keeper pin 620 ensures breathing tube 110 is not inadvertently removed, and is positioned so as to avoid introducing any bilge water. The embodiment of the invention shown in FIGS. 10 and 11 works on the same principle except the emergency breathing system 100 passes through the deck aperture 4*d* in a water-tight manner and a pocket is attached to deck 4*a* for holding end 110*a* as shown in phantom in FIG. 10.

Thus, it is readily apparent that the emergency device of the invention provides several advantages over the prior art. The present invention, being permanently mounted in the skirt or deck, is normally available to the kayaker. It does not have to be remembered and included at the outset of the trip. Weather and water conditions often deteriorate unexpectedly, possibly creating a need for the device that is unanticipated. Another advantage is that the location of the device in an aperture forward of the kayaker promotes a defensive, tucked position while the device is being used. This position is less likely to result in the head of the kayaker hitting underwater obstruction. A further advantage is that the head and torso of the kayaker are not restricted in moving through the extreme positions necessary to perform a rolling maneuver. To roll the kayak upright, a kayaker must stretch forward, to both the left and right extremes, as well as back against the back deck. By necessity, the kayaker is encouraged to perform the roll while holding his or her breath, as is normally taught. If the roll fails, air is available through the device in the tucked position.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims. For example, the entire air breathing system as described above could be built into a kayak during manufacture, thereby possibly changing the requirements for fastening hardware, or the air breathing system may be conveniently retrofitted into existing kayaks. Various components of the invention (such as the valve in the mouthpiece and/or the reservoir) can be modified or eliminated without negating its usefulness. Also, the present invention is applicable to any small boats or the like, not just to kayaks. Thus, the terms "kayak" and "kayaker" are to be broadly construed, and not by way of any limitation.

What is claimed is:

1. A kayak and emergency air system combination comprising:

a kayak skirt having a skirt opening;

a kayak body having a body opening and an upper deck, said kayak skirt or said upper deck having an aperture; and an emergency air system comprising a mouthpiece and a breathing tube coupled to the mouthpiece, the breathing tube passing through the aperture in the kayak skirt or in the upper deck of said kayak body.

2. The kayak and emergency air system combination as claimed in claim 1 wherein said mouthpiece is made of a flexible material comprising silicone or vinyl, and wherein the mouthpiece comprises an integral, water resisting top flap which can be opened by a kayaker when downward pressure is applied on the mouthpiece with the kayaker's teeth.

3. The kayak and emergency air system combination as claimed in claim 1 wherein said breathing tube is made of a flexible plastic material comprising silicone or vinyl, and wherein a height of said breathing tube above the top surface of the kayak body can be slideably adjusted by loosening a threaded nut disposed around the breathing tube, and wherein the emergency air system further comprises a rubber washer which frictionally impinges on said breathing tube when the threaded nut is tightened.

4. The kayak and emergency air system combination as claimed in claim 1 wherein the breathing tube comprises a lower end which is internal to said kayak body and is scalloped to prevent restriction of air flow.

5. The kayak and emergency air system combination as claimed in claim 1 wherein the emergency air system further comprises a hollow chamber which is coupled to said breathing tube, wherein the hollow chamber is capable of catching unwanted purged water so that water in the breathing tube does not flow into a kayaker's mouth when said kayaker is wearing the mouthpiece.

6. The kayak and emergency air system combination as claimed in claim 1 wherein said breathing tube has an accordion construction.

7. The kayak and emergency air system combination as claimed in claim 1 wherein said mouthpiece comprises a cover which has an inverted V shape to allow a kayaker's mouth to engage said mouthpiece.

8. The kayak and emergency air system as claimed in claim 1 wherein a length of the breathing tube above the top surface of the kayak is adjustable.

9. The kayak and emergency air system combination of claim 1 wherein the emergency air system further comprises a pair of opposed flat washers and an internally threaded nut, wherein the opposed flat washers are forced together when the internally threaded nut is tightened.

10. The kayak and emergency air system combination of claim 1 wherein the breathing tube passes through the opening in the kayak skirt.

11. A kayak and emergency air system combination comprising:

a kayak skirt;

a kayak body having an upper deck, wherein the kayak body is adapted to receive a kayaker; and an emergency air system comprising a pair of opposed, flat washers, an internally threaded nut, a mouthpiece, and a breathing tube coupled to the mouthpiece, the breathing tube disposed perpendicular to a top surface of the kayak body, and secured to the kayak skirt or to the upper deck of said kayak body with the pair of opposed flat washers, which are forced together using the internally threaded nut.

12. An emergency air system for attachment to a kayak skirt or an upper deck of a kayak body, the emergency air system comprising:

a breathing tube having a first end and a second end, wherein the second end of the breathing tube comprises scallops;

a mouthpiece coupled to the first end; and a securing device capable of securing the breathing tube in a hole in the kayak skirt or in a hole in the upper deck of the kayak body.

13. An emergency air system for attachment to a kayak skirt or an upper deck of a kayak body, the emergency air system comprising:

a breathing tube having a first end and a second end;

a mouthpiece coupled to the first end; and a securing device capable of securing the breathing tube in a hole in the kayak skirt or in a hole in the upper deck of the kayak body, wherein the securing device comprises a pair of opposing flat washers adapted to sandwich portions of the kayak skirt or the kayak body defining the hole.

14. The emergency air system of claim 13 wherein the securing device further comprises an internally threaded nut disposed around the breathing tube.

15. A kayak and emergency air system combination comprising:

a kayak skirt;

a kayak body having an upper deck;

an emergency air system for attachment to the kayak skirt or the upper deck of the kayak body, the emergency air system comprising:

a breathing tube having a first end and a second end;

a mouthpiece coupled to the first end; and a securing device capable of securing the breathing tube in a hole in the kayak skirt or in a hole in the upper deck of the kayak body, wherein the securing device sandwiches the kayak skirt or the kayak body to secure the breathing tube.

16. A kayak comprising a kayak body having a top deck with a deck opening; a kayak skirt disposed on said kayak body and around said kayak opening, said kayak skirt including a structure defining a skirt opening and a skirt aperture; and an emergency air system at least partly supported by said kayak skirt and including a structural portion passing through said skirt aperture.

17. A kayak comprising a kayak body having a kayak deck defining a deck opening and a deck aperture; and an emergency air system at least partly supported by said kayak deck and including a structural portion passing through said deck aperture.

18. A method for a kayaker sitting in a kayak to receive a supply of air under water after the kayak has overturned comprising:

providing a kayak having a kayaker with an upper torso extending through a deck opening of a top deck and having an emergency air system disposed within a deck aperture of the top deck or within a skirt aperture of the kayak;

capsizing the kayak to cause the upper torso of the kayaker to be submerged in water;

bending the upper torso forward until the mouth of the kayaker is in close proximity of a mouthpiece of the emergency air system;

disposing the mouthpiece in the mouth of the kayaker such that the kayaker is able to receive a supply of air.

19. The method of claim 18 wherein said disposing comprises biting of the mouthpiece by the kayaker.

20. The method of claim 18 wherein said bending continues until said upper torso is generally parallel to said top deck.

21. A method for retrofitting a kayak with an emergency air system comprising:

providing a kayak having a top deck including a deck opening and having a kayak skirt with a skirt opening;

placing an aperture in either the top deck or the kayak skirt; and disposing an emergency air system in the aperture.

* * * * *